US006848931B2

(12) United States Patent
McMullen et al.

(10) Patent No.: US 6,848,931 B2
(45) Date of Patent: Feb. 1, 2005

(54) QUICK ATTACHMENT SMA CONNECTOR

(75) Inventors: Norman McMullen, Frankfort, IL (US); Jeff Ferdina, LaGrange, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/294,067

(22) Filed: Nov. 14, 2002

(65) Prior Publication Data

US 2004/0014350 A1 Jan. 22, 2004

Related U.S. Application Data

(60) Provisional application No. 60/397,148, filed on Jul. 19, 2002.

(51) Int. Cl.[7] ..... H01R 13/627; H01R 9/05

(52) U.S. Cl. ..... 439/350; 439/578; 439/584

(58) Field of Search ..... 439/350, 349, 439/352, 357, 358, 578, 584

(56) References Cited

U.S. PATENT DOCUMENTS

| | | | |
|---|---|---|---|
| 3,430,184 | A | 2/1969 | Acord |
| 3,671,922 | A | 6/1972 | Zerlin et al. |
| 3,694,793 | A | 9/1972 | Concelman |
| 3,888,559 | A | 6/1975 | Geib |
| 3,953,098 | A | 4/1976 | Avery et al. |
| 4,017,139 | A | 4/1977 | Nelson |
| 4,138,181 | A | 2/1979 | Hacker et al. |
| 4,397,515 | A | 8/1983 | Russell |
| 4,561,716 | A | 12/1985 | Acke |
| 4,620,760 | A | 11/1986 | Duncan |
| 4,632,480 | A | 12/1986 | Carpenter |
| 4,846,714 | A | 7/1989 | Welsby et al. |
| 4,941,846 | A | 7/1990 | Guimond et al. |
| 5,435,745 | A | 7/1995 | Booth |
| 5,879,188 | A | 3/1999 | Clyatt |
| 5,938,465 | A | 8/1999 | Fox, Sr. |
| 6,210,221 | B1 | 4/2001 | Maury |

*Primary Examiner*—Chandrika Prasad
(74) *Attorney, Agent, or Firm*—Welsh & Katz, Ltd.

(57) ABSTRACT

A coaxial connector combination is provided having a male and a female portion. The coaxial connector combination includes a female portion having a tubular body with an engagement end and an annular locking groove disposed around an outer surface of the tubular body spaced back from the engagement end and a male portion. The male portion further includes a sleeve, a plurality of pawls, each extending outwards from an engagement end of the sleeve to form an annulate of spaced-apart pawls disposed around a center axis of the sleeve, said annulate of pawls being adapted to engage the outer surface of the tubular body and wherein a catch on an engagement end of each pawl of the plurality pawls engages the annular groove of the female portion and a locking collar disposed around an outside surface of the plurality of pawls and adapted to slidably lock the catches of the distal end of the plurality of pawls into the annular locking groove.

23 Claims, 4 Drawing Sheets

QUICK ATTACHMENT SMA CONNECTOR

This application claims the benefit of priority from U.S. Provisional Patent Application Ser. No. 60/397,148, entitled Quick Attachment SMA Connector, filed on Jul. 19, 2002. Provisional Patent Application Ser. No. 60/397,148 is hereby incorporated by reference in its entirety.

FIELD OF THE INVENTION

The field of the invention relates to radio frequency communication systems and more particularly to radio frequency connectors.

BACKGROUND OF THE INVENTION

Coaxial connectors for radio frequency (rf) signals are known. Such connectors are typically used with a coaxial cable containing an external conductor/shield surrounding one or more internal conductors. The coaxial connector functions to align and provide an electrical path to the respective ends of the conductors while providing a continuous shield to minimize rf leakage.

The alignment and attachment of the conductors within some rf connectors (e.g., SMA connectors, by Amphenol, Inc.) occurs via operation of a conductor interface. A conductor interface is a precision coupler within the SMA connector that allows opposing conductors to be inserted from each end and brought into alignment and attached via operation of the connector.

The SMA connector includes a female portion and a male portion. The male portion contains the conductor interface and a threaded nut used to engage the female portion.

The female portion includes a tubular housing that functions to accept the conductor interface of the male portion and align the conductor interface with a mating rf conductor held within the female portion. The tubular housing of the female portion is provided with an external thread to accept the threaded nut of the male portion.

The tightening of the threaded nut of the male portion onto the external thread of the female portion functions to bring the rf conductors into physical contact thereby reducing electrical resistance and rf leakage. The threaded nut is often tightened to a predetermined torque range to ensure proper interface pressures are achieved within the connector.

While existing connectors work relatively well, they are time consuming to install. To connect or disconnect conductors, the threaded nut must be disengaged before the connection may be broken. Further, once reconnection is required, the threaded nut must be retightened to a proper torque setting. In addition, temperature cycling and/or rotational torque applied to the cable assembly can cause the threaded nut to back-off below the minimum torque value required, negatively impacting electrical and mechanical performance. Because of the importance of rf communication systems a need exists for a better method of securing rf connectors.

DETAILED DESCRIPTION OF AN ILLUSTRATED EMBODIMENT

Figure 1:
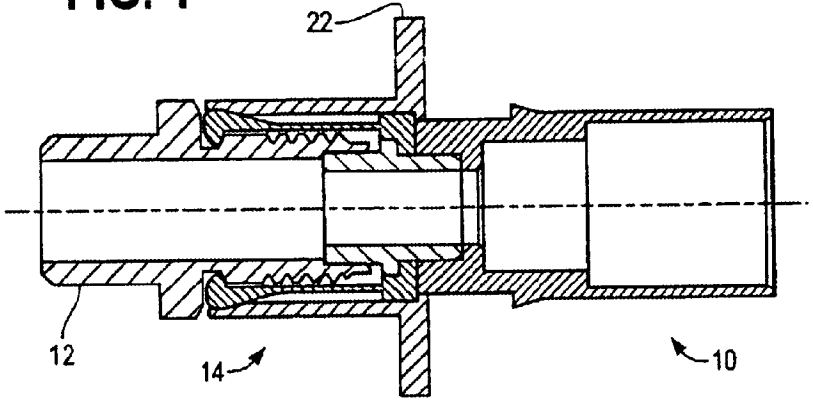
FIG. 1 is a cut-away side view of a coaxial connector combination in accordance with an illustrated embodiment of the invention.
Figure 2:
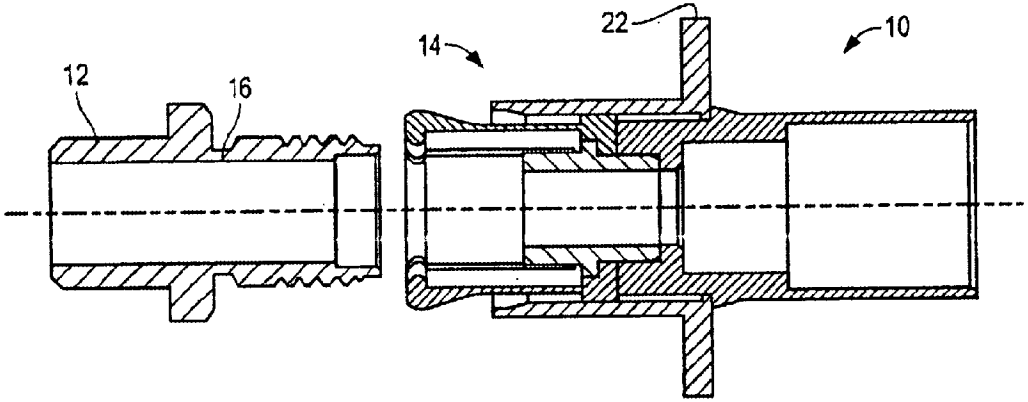
FIG. 2 is a side view of the connector of FIG. 1 with the female portion separated from the male portion.

FIGS. 1 and 2 are a cut-away side views of a quick attachment coaxial connector combination 10, shown generally under an illustrated embodiment of the invention. FIG. 1 shows a female portion 12 engaged with the male portion 14. FIG. 2 shows the female portion 12 disengaged from the male portion 14.

Under the illustrated embodiment, a laterally sliding collar 22 is used to lock or unlock the connector combination 10. As used herein, a laterally sliding collar refers to a collar that locks the male portion 14 to the female portion 12 by virtue of its sliding motion along an axis of engagement of the connectors. It does not refer to connectors (e.g., BNC connectors) where the collar has a receptacle to accept and lock with a peg on an opposing portion of the connector as a direct result of twisting the collar.

Sliding the collar 22 to the left 21 (as shown in FIG. 1) locks the male portion 14 to the female portion 12. Sliding the collar to the right 23 (as shown in FIG. 2) allows for the convenient release of the male portion 14 from the female portion 12.

Figure 3:
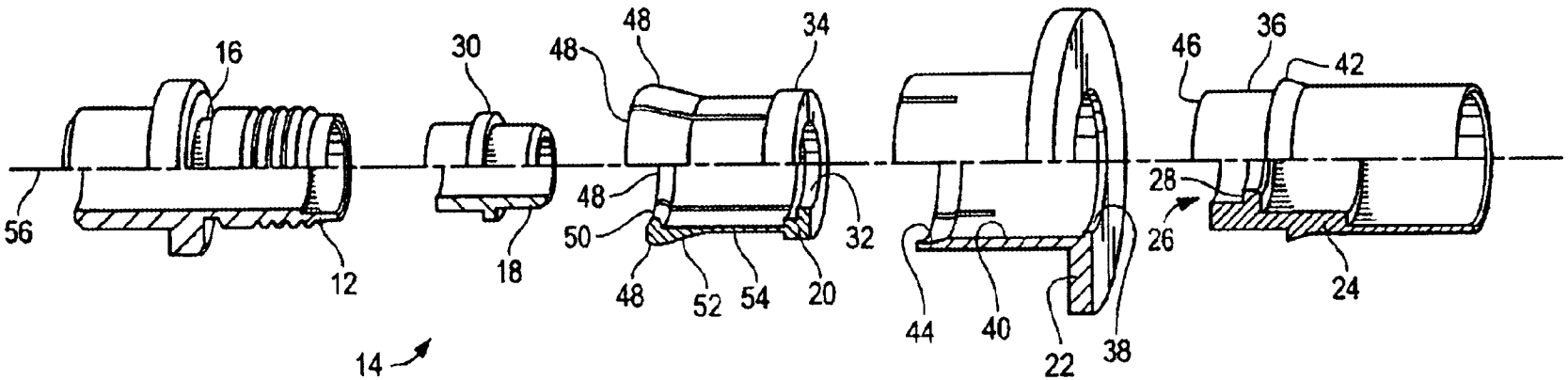
FIG. 3 is an exploded view of the connector of FIG. 1.

FIG. 3 shows a cut-away exploded view of the connector 10. Reference shall be made to the FIGS. 1–3 as appropriate to an understanding of the invention.

It should be noted that the connector 10 of FIGS. 1–3 is not shown with a communication medium (e.g., rf center conductors). However, the use of rf conductors with connectors such as that shown in FIGS. 1–3 is well understood by those of skill in the art and will not be discussed further.

While the connector 10 may be used in a number of different environments, the connector 10 may generally be used for aligning and connecting rf conductors. Further, for purposes of illustration, but not limitation, the connector 10 will generally be described in the context of a SMA connector. However, other applications will be readily apparent to those of skill in the art.

In general, the female portion 12 may be a conventional female portion of a SMA connector with one exception. The exception is the presence of a groove 16 set back from an engagement end of the female portion 12.

The male portion 14 may include a number of discrete portions including a sleeve 24. Within the sleeve 24, a receptacle 26 may be provided for a conventional conductor interface 18. The male portion 14 may be considered as being comprised of the sleeve 24 and conductor interface 18 by themselves or may also include the locking mechanism described in more detail below.

The receptacle 26 may be sized to accept the conductor interface 18 by press-fitting. A shoulder 28 may be provided within the sleeve 24 as a stop as the conductor interface 18 is pressed into the sleeve 24.

The locking mechanism of the connector 10 will now be discussed in more detail. The locking mechanism may generally include a clamp 20 and collar 22.

An outer diameter of the clamp 20 may be sized to fit partially or completely within a center section 40 of the collar 22. An outer diameter of a flange 34 on a back of the clamp 20 may be larger than an aperture 38 within a flange of the collar 22 so that the flange of the collar 22 cannot be slid past the flange 34 of the clamp 20. The aperture 38 in the flange of the collar 22 may, in turn, be of sufficient size to fit over an end portion 36 on an engagement end 46 of the sleeve 24.

The clamp 20 and collar 22 may be captured between the conductor interface 18 and sleeve 24. For example, an outer diameter of a ridge 30 of the conductor interface 18 may be provided with a larger outer diameter than an inner diameter of a center aperture 32. To assemble the male portion 14, first the collar 22 and then the clamp 20 may be assembled onto the sleeve 24. Once assembled to the sleeve 24, the conductor interface 18 may be inserted through the aperture 32 of the clamp 20 and pressed into the receptacle 26 thereby forming a completed assembly.

The presence of the shoulder 28 allows the end of the conductor interface 18 to bottom out against the shoulder 28 before the ridge 30 makes contact with the flange 34. The result is that the clamp 20 is able to float within the remaining space between the ridge 30 and engagement end 46 of the sleeve 24.

After assembly, the collar 22 remains disposed at least partially over the clamp 20 and engagement end 46 of the sleeve 24. As mentioned above, the flange 34 of the clamp 20 has an outer diameter that is smaller than an inner diameter of the center section 40 of the collar 20, but which is a slightly larger diameter than the inner diameter of the aperture 38 within the flange of the collar 22. The result is that the collar 22 is internally supported by the flange 34 and end portion 36 and easily slides from an unlocked position where the flange of the collar 22 contacts the ridge 42 to a locked position where the collar 22 overlaps and surrounds the clamp 20.

The clamp 20 may be provided with a number of pawls 48 disposed around a center engagement axis 56 of the male and female portions 12, 14. Each pawl 48 may be provided with a catch 50. Each catch 50 may be provided with a tapered advancing edge and opposing back edge. Each pawl 48 may include a relatively thin resilient end 54 and a tapered end 52 that includes the catch 50.

During use, the pawls 48 form an initial receptacle for the female portion 12 as it is inserted into the male portion 14. Once the female portion 12 is fully inserted into the male portion 14, the pawls 48 fully surround the engagement end of the female portion 12 with the catches 50 positioned directly over the groove 16.

The catches 50 may either be biased into the groove 16 after insertion by the resilient end 54 or may float above the groove 16. Where the catches are biased into the groove 16 during engagement, the tapered edges of the catch 50 allow for unimpeded insertion and removal of the female portion 12 from the male portion 14.

To lock the combination 10 together, a user may grasp the flange of the collar 22 and move it towards an engagement end of the male portion 14 (i.e., towards the female portion 12). As the collar 22 moves towards the engagement end, a tapered portion 44 of the collar 22 engages the tapered end 52 of the pawls 48 thereby urging the catches 50 into the groove 16.

Once the catches 50 are fully depressed into the groove 16 by the tapered portion 44 (as shown in FIG. 1), the collar 22 continues to move towards the engagement end until a portion of the middle portion 40 engages the back side of the pawls 48 in a fully locked position. Since the middle portion 40 has a relatively constant diameter, the collar 22 now moves easily into a final locked position.

Once the collar 22 has been moved into the locked position (as shown in FIG. 1), the catches 50 fully engage the groove 16 and the connector 10 cannot be pulled apart. To release the connector 10, the collar 22 is simply retracted (i.e., moved to the right as shown in FIG. 2) and 2) and the female portion 12 may be easily pulled out of the male portion 14.

In another illustrated embodiment of the invention, the lateral sliding motion that accomplishes locking within the collar 22 of FIGS. 1–3 may be aided by the use of a thread 109. In this case, the sliding collar 22 of the connector 10 of FIGS. 1–3 may be replaced with a threaded collar 108 (FIGS. 4–6) with a retaining ring 110. The lateral sliding motion of the collar 108, in this case, is also accompanied by rotation as the collar 108 advances along the threads. The lateral sliding motion of the collar 108 and retaining ring 110 functions to engage an actuator 120 that controls a set of pawls 122. The interaction of the collar 108, retaining ring 110 and actuator 120 causes the pawls 122 to move into and out of a groove 106 (FIG. 5) thereby locking the male portion 102 to the female portion 104.

Figure 6:
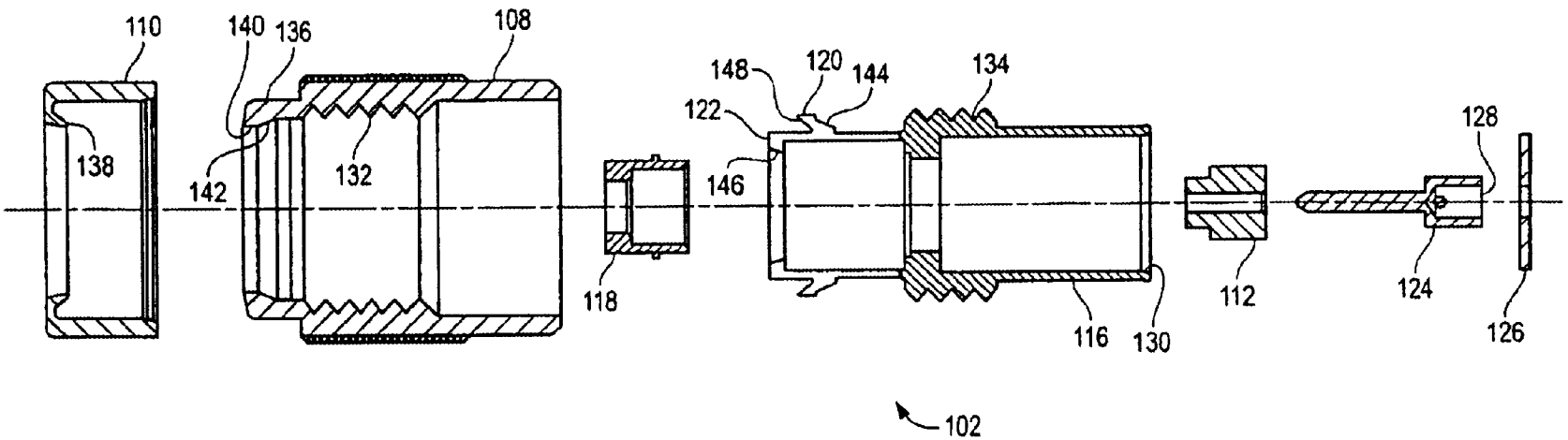
FIG. 6 is an exploded view of the connector of FIG. 4.

FIG. 6 is an exploded view of the male portion 102. The male portion 102 generally includes an interface 118, body 116, insulator 112, retaining ring 110, outer collar 108, inner contact 124 and disc 126.

To assemble the male portion 102, the disc 126 may be slid over the inner conductor of the coaxial cable (not shown) and the inner conductor slid into and soldered within an aperture 128 of the inner contact 124. The insulator 112 may then be slid onto the inner conductor, followed by the body 116 and interface 118. The outer shield of the coaxial cable may be soldered to an outer rim 130 of the body 116.

To complete assembly of the male portion 102, the retaining ring 110 may be pressed onto a shoulder 136 of the collar 108 and the assembled collar 108 and ring 110 slid over the body 116. An inner thread 132 of the collar 108 may be threaded onto an outer thread 134 of the body 116. The assembled collar 108 and ring 110 may be screwed (threaded) onto the body 116 until an inner flange 140 of the collar 108 has advanced past the actuator 120. A tapered inner surface 142 of the flange 140 functions to urge the actuator 120 inwards until the flange has passed over the actuator 120 at which time the actuator 120 returns to its previous position.

Figure 4:
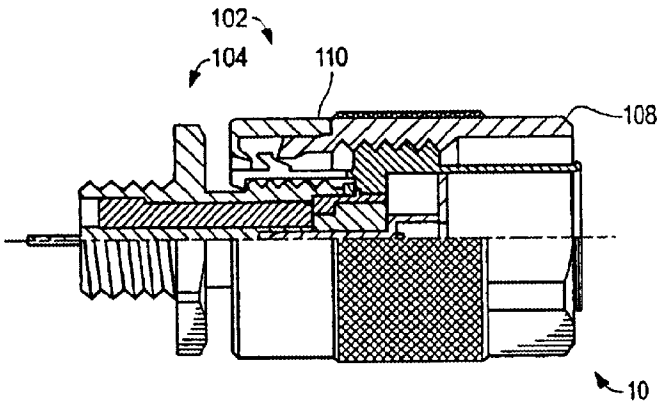
FIG. 4 is a cut-away side view of a coaxial connector combination in accordance with an alternate embodiment of the invention.
Figure 5:
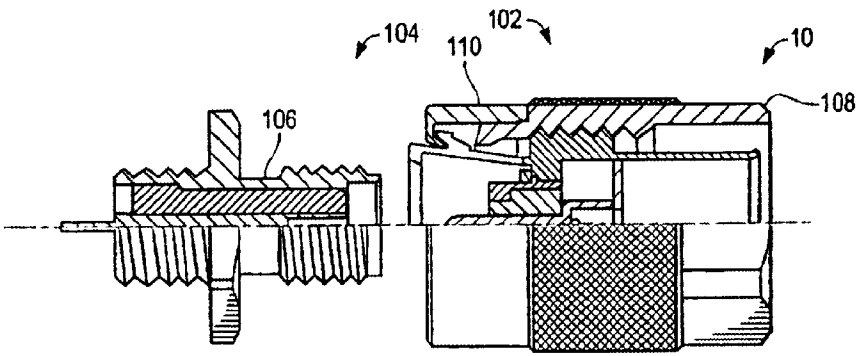
FIG. 5. is a side view of the connector of FIG. 4 with the female portion separated from the male portion.

Once the flange 140 of the collar 108 has passed over the actuator 120, the actuator 120 is trapped between a spur 138 on the retaining ring 110 and the flange 140. To lock the male portion 102 to the female portion 104, the female portion 106 may be inserted into the male portion 102 as shown in FIG. 4. The collar 108 may then be rotated causing the collar assembly 108, 110 to advance along the threads 132, 134 towards the left (the engagement end) as shown in FIG. 4. As the collar assembly 108, 110 advances, the flange 140 begins to engage a tapered portion 144 of the actuator 120, forcing the pawls 122 (and catches 146) into the groove 106 of the female portion 104.

To release the connector 10, the collar assembly 108, 110 may be rotated in the opposite direction. As the flange 140 retracts (via interaction of the threads 132, 134), the pawls 122 are released. As the collar assembly 108, 110 continues to retract, a spur 138 on the ring 110 engages a tapered rear portion 148 on the actuator 120 thereby pulling the pawls 122 (and catches 146) upwards and out of the groove 106.

The groove 106 in the female connector is angled at 30 degrees. This angle is used to draw the male interfaces into the female, by way of the pawls 122, and generates the required interface pressure to maintain phase, PIM and VSWR stability. This angle also allows the connector 10 to function with dimensional variations due to machining tolerances.

A specific embodiment of a method and apparatus of a connector combination according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention, any and all modifications, variations, or equivalents that fall within the true spirit and scope of the basic underlying principles disclosed and claimed herein.

What is claimed is:

1. A coaxial connector combination having a male and a female portion, said coaxial connector combination comprising:

a female portion;

a male portion inserted into the female portion to form a connection between the female and male portion; and a sliding collar slideable along an axis of insertion of the male portion into the female portion and adapted to lock the male portion to the connected female portion, said sliding collar having a first static position relative to the connected female and male portions in which the female portion is locked to the male portion and a second static position relative to the connected female and male portions in which the female portion is unlocked from the male portion and wherein the sliding collar does not have a spring that biases the sliding collar towards the first static position.

2. The coaxial connector combination as in claim 1 wherein the male portion further comprises a sleeve and a conductor interface.

3. The coaxial connector combination as in claim 2 further comprising a plurality of pawls, each extending outwards from an engagement end of the sleeve to form an annulate of spaced-apart pawls disposed around a center engagement axis of the male portion.

4. The coaxial connector combination as in claim 3 wherein the plurality of pawls further comprise an annular flange disposed around the center line and coupled to a sleeve end of each of the plurality of pawls.

5. The coaxial connector combination as in claim 4 wherein the plurality of pawls and annular flange further comprises a unitary assembly.

6. The coaxial connector combination as in claim 4 wherein the annular flange further comprises a conductor interface with a center ridge extending through a center hole of the flange into a center receptacle of the sleeve.

7. The coaxial connector combination as in claim 5 wherein the conductor interface is press-fit into the center hole of the sleeve capturing the annular flange between the center ridge and the engagement end of the sleeve.

8. The coaxial connector combination as in claim 1 wherein the catch on the plurality of pawls further comprises a tapered advancing edge.

9. The coaxial connector combination as in claim 8 wherein the annulate of pawls forms a receptacle for the female portion.

10. The coaxial connector combination as in claim 9 wherein an inside circle formed by the tapered advancing edges of the annular circle of pawls further comprises a smaller relative diameter than an outside diameter of the female portion.

11. The coaxial connector combination as in claim 10 wherein the plurality of pawls further comprise resilient members that resiliently deflect upon insertion of the female portion.

12. The coaxial connector combination as in claim 1 wherein the male portion further comprises an external annular thread.

13. The coaxial connector combination as in claim 12 wherein the sliding collar further comprises an internal thread adapted to engage the external annular thread of the male portion.

14. A coaxial connector combination having a male and a female portion, said coaxial connector combination comprising:

a female portion having a tubular body with an engagement end and an annular locking groove disposed around an outer surface of the tubular body spaced back from the engagement end; and a male portion for insertion into the female portion to form a connected female and male portions, said male portion further comprising:

a sleeve;

a plurality of pawls, each extending outwards from an engagement end of the sleeve to form an annulate of spaced-apart pawls disposed around a center axis of the sleeve, said annulate of pawls being adapted to engage the outer surface of the tubular body and wherein a catch on an engagement end of each pawl of the plurality pawls engages the annular groove of the female portion; and a locking collar disposed around an outside surface of the plurality of pawls and adapted to slidably lock the catches of the distal end of the plurality of pawls into the annular locking groove, said locking collar having a first static position in which the female portion is locked to the male portion and a second static position different from the first static position in which the female portion is unlocked from the male portion and wherein the locking collar does not have a spring that biases the locking collar towards the first static position.

15. The coaxial connector combination as in claim 14 wherein the plurality of pawls further comprise an annular flange disposed around the center line and coupled to a sleeve end of each of the plurality of pawls.

16. The coaxial connector combination as in claim 15 wherein the plurality of pawls and annular flange further comprises a unitary assembly.

17. The coaxial connector combination as in claim 15 wherein the annular flange further comprises a conductor interface with a center ridge, said conductor interface extending through a center hole of the flange into a center hole of the sleeve.

18. The coaxial connector combination as in claim 17 wherein the interface peg is press-fit into the center hole of the sleeve capturing the annular flange between the center ridge and the engagement end of the sleeve.

19. The coaxial connector combination as in claim 14 wherein the catch on the plurality of pawls further comprises a tapered advancing edge.

20. The coaxial connector combination as in claim 19 wherein the annulate of pawls forms a receptacle for the female portion.

21. The coaxial connector combination as in claim 20 wherein an inside circle formed by the tapered advancing edges of the annular circle of pawls further comprises a smaller relative diameter than an outside diameter of the female portion.

22. The coaxial connector combination as in claim 21 wherein the plurality of pawls further comprise resilient members that resiliently deflect upon insertion of the female portion.

23. The coaxial connector as in claim 14 wherein the locking collar further comprises a spur that pulls a pawl of the plurality of pawls out of the annular groove.

* * * * *